United States Patent [19]

Mason et al.

[11] Patent Number: 4,979,987

[45] Date of Patent: Dec. 25, 1990

[54] PRECIOUS METALS RECOVERY FROM REFRACTORY CARBONATE ORES

[75] Inventors: Peter C. Mason, North Vancouver; Patrick T. O'Kane, Coquitlam; Robert Pendreigh, West Vancouver, all of Canada

[73] Assignee: First Miss Gold, Inc., Reno, Nev.

[21] Appl. No.: 221,085

[22] Filed: Jul. 19, 1988

[51] Int. Cl.[5] ..... C01G 5/00; C01G 7/00; C22B 11/00

[52] U.S. Cl. ..... 75/744; 75/743; 75/747; 423/27; 423/29; 423/30; 423/31

[58] Field of Search ..... 75/118 R, 105, 101 R; 423/27, 29, 30, 31

[56] References Cited

U.S. PATENT DOCUMENTS

| | | | |
|---|---|---|---|
| T. 104,001 | 3/1984 | Kunter et al. | 75/118 R |
| 1,308,639 | 7/1919 | Newdick | 299/66 |
| 1,461,807 | 7/1923 | Silver | 75/118 R |
| 2,147,009 | 2/1939 | Chapman | 75/118 R |
| 2,234,140 | 3/1941 | Falconer et al. | 75/118 R |
| 2,315,187 | 3/1943 | Chapman | 75/118 R |
| 2,470,707 | 4/1948 | Herrmann | 75/101 R |
| 2,476,420 | 7/1949 | Krebs | 75/118 R |
| 2,478,652 | 8/1949 | Byler et al. | 75/103 |
| 2,479,930 | 8/1949 | Herkenhoff | 75/106 |
| 2,502,490 | 4/1950 | Sweet | 422/106 |
| 2,519,770 | 8/1950 | Kramer | 422/199 |
| 2,545,239 | 3/1951 | McQuiston, Jr. et al. | 75/106 |
| 2,579,531 | 12/1951 | Zadra | 204/109 |
| 2,588,450 | 3/1952 | Zadra | 204/109 |
| 2,612,470 | 9/1952 | Griess, Jr. et al. | 204/109 |
| 2,646,347 | 7/1953 | Jacks et al. | 422/242 |
| 2,658,827 | 11/1953 | Rizo-Patron | 75/118 R |
| 2,726,934 | 12/1955 | Forward et al. | 75/119 |
| 2,777,764 | 1/1957 | Hedley et al. | 75/105 |
| 2,804,379 | 8/1957 | Wistrich et al. | 23/270.5 |
| 2,827,372 | 3/1958 | Britton | 75/118 R |
| 2,836,490 | 5/1958 | Mackiw et al. | 75/115 |
| 2,867,529 | 1/1959 | Forward et al. | 75/118 R |
| 2,893,846 | 7/1959 | Wistrich et al. | 23/270.5 |
| 2,919,802 | 1/1960 | Drake | 209/167 |
| 2,954,290 | 9/1960 | Teichmann et al. | 75/118 R |

(List continued on next page.)

FOREIGN PATENT DOCUMENTS

| | | |
|---|---|---|
| 364574 | 11/1973 | U.S.S.R. . |
| 487971 | 1/1976 | U.S.S.R. . |
| 722971 | 3/1980 | U.S.S.R. . |
| 1491851 | 11/1977 | United Kingdom . |

OTHER PUBLICATIONS

Performance of a New Automatic Carbon Dioxide Coulometer; by E. W. D. Huffman, Jr., Microchemical Jr. 22, pp. 567–573.

Manual of Analytical Methods for the Uranium Concentrating Plant; by J. C. Ingles, Mines Branch Monograph 866, Mines Branch, Department of Mines and Technical Surveys, Ottawa, Canada, 1958, pp. 1–10.

"Process Options for the Treatment of Refractory Gold Ores and Concentrates" by P. G. Mason and P. T. O'Kane, Nov. 29, 1985.

"Pressure Oxidation—A New Tool for Refractory Gold Ores and Concentrates" by L. S. Gormely and P. T. O'Kane, Nov. 30, 1984.

"Refractory Gold Ore Oxidation—Simulation of Continuous Flow" by A. S. Hayden, P. G. Mason & W. T. Yen, presented at the 26th Annual Conference of Metallurgists, 1987, Winnipeg, Manitoba.

*Primary Examiner*—John Doll
*Assistant Examiner*—Steven J. Bos
*Attorney, Agent, or Firm*—Sheridan, Ross & McIntosh

[57] ABSTRACT

Precious metal values, particularly gold and silver, are liberated from refractory, carbonate ores by adjusting the molar ratio of sulfide to total acid consumers to between about 1.2 and about 3.2 in the ore feed to a pressure oxidation process. The ore is contacted with oxygen to oxidize sulfide in the ore with at least about 65 percent of the sulfide oxidation occurring in a first oxidation zone at a temperature above about 360° F. The oxidation of sulfide forms at least about 5 grams of free sulfuric acid in the first oxidation zone. The oxidation process is continued in subsequent oxidation zones. A gas stream is removed from the oxidation zones and oxygen is separated from carbon dioxide and other inerts in the gas stream and the purified oxygen is recycled to the oxidation zones.

17 Claims, 2 Drawing Sheets

U.S. PATENT DOCUMENTS

| | | | |
|---|---|---|---|
| 2,989,380 | 6/1961 | Weiss et al. | 23/277 |
| 3,010,803 | 11/1961 | Wistrich et al. | 23/270.5 |
| 3,010,804 | 11/1961 | Wistrich et al. | 23/270.5 |
| 3,013,866 | 12/1961 | Samaniego et al. | 23/270.5 |
| 3,018,170 | 1/1962 | Soloducha | 23/260 |
| 3,088,820 | 5/1963 | Mackiw et al. | 75/7 |
| 3,130,015 | 4/1964 | Monroe | 23/290 |
| 3,174,848 | 3/1965 | Bruce | 75/105 |
| 3,215,611 | 11/1965 | Pawick et al. | 204/108 |
| 3,266,872 | 8/1966 | Terao et al. | 23/285 |
| 3,285,705 | 11/1966 | Zuiderweg et al. | 23/270.5 |
| 3,293,027 | 12/1966 | Mackiw et al. | 75/119 |
| 3,322,505 | 5/1967 | Weber | 23/259.1 |
| 3,357,823 | 12/1967 | Tuwiner | 75/118 R |
| 3,440,256 | 4/1969 | Rich | 23/260 |
| 3,463,710 | 8/1969 | Lower | 204/106 |
| 3,477,928 | 11/1969 | Coltrinari | 204/123 |
| 3,522,018 | 7/1970 | Bachmann et al. | 23/285 |
| 3,523,762 | 8/1970 | Broughton | 23/285 |
| 3,529,026 | 9/1970 | Blumcke et al. | 260/653.4 |
| 3,537,824 | 11/1970 | Schmidt | 23/280 |
| 3,547,589 | 12/1970 | Rice et al. | 23/266 |
| 3,549,351 | 12/1970 | Lundquist | 75/6 |
| 3,574,600 | 4/1971 | Scholmer et al. | 75/105 |
| 3,599,601 | 8/1971 | Ishikawa | 118/50 |
| 3,615,260 | 10/1971 | Hanson | 23/299 |
| 3,639,925 | 2/1972 | Scheiner et al. | 75/101 R |
| 3,672,873 | 6/1972 | Huggins et al. | 75/101 R |
| 3,687,635 | 8/1972 | Wijard et al. | 23/290 |
| 3,743,501 | 7/1973 | Cusanelli et al. | 75/109 |
| 3,761,566 | 9/1973 | Michal | 423/141 |
| 3,809,549 | 5/1974 | Opratko et al. | 75/101 R |
| 3,846,124 | 11/1974 | Guay | 75/112 |
| 3,867,268 | 2/1975 | Kawulka et al. | 204/119 |
| 3,879,270 | 4/1975 | Kowalski | 204/52 R |
| 3,909,248 | 9/1975 | Ryan et al. | 75/101 R |
| 3,914,162 | 10/1975 | Kowalski | 204/466 |
| 3,935,006 | 1/1976 | Fischer | 75/118 R |
| 3,961,908 | 6/1976 | Touro | 423/35 |
| 3,962,402 | 6/1976 | Touro | 423/27 |
| 4,004,991 | 1/1977 | Veltman et al. | 204/119 |
| 4,029,736 | 6/1977 | Melkonian | 423/118 |
| 4,038,362 | 7/1977 | Guay | 423/40 |
| 4,044,096 | 8/1977 | Queneau et al. | 423/150 |
| 4,052,151 | 10/1977 | Reichrt et al. | 432/115 |
| 4,053,305 | 10/1977 | Smyres et al. | 75/104 |
| 4,056,261 | 11/1977 | Darrah | 266/101 |
| 4,085,266 | 4/1978 | Nakai et al. | 526/65 |
| 4,094,668 | 6/1978 | Yannopoulos et al. | 75/99 |
| 4,097,271 | 6/1978 | Swinkels et al. | 75/104 |
| 4,123,600 | 10/1978 | Kita et al. | 526/65 |
| 4,124,462 | 11/1978 | Reinhardt et al. | 423/24 |
| 4,126,757 | 11/1978 | Smith, Jr. et al. | 13/25 |
| 4,135,918 | 1/1979 | Ettel et al. | 75/117 |
| 4,149,880 | 4/1979 | Prater et al. | 75/117 |
| 4,167,470 | 9/1979 | Karnofsky | 208/8 LE |
| 4,188,208 | 2/1980 | Guay | 75/105 |
| 4,219,354 | 8/1980 | Rastas et al. | 75/101 R |
| 4,249,032 | 2/1981 | Smith, Jr. et al. | 13/25 |
| 4,252,924 | 2/1981 | Chatterjee | 526/65 |
| 4,259,107 | 3/1981 | Guay | 75/105 |
| 4,266,972 | 5/1981 | Redondo-Abad et al. | 75/101 R |
| 4,267,069 | 5/1981 | Davidson et al. | 75/118 R |
| 4,279,867 | 7/1981 | Weir | 423/26 |
| 4,279,868 | 7/1981 | Von Kohorn | 423/29 |
| 4,289,532 | 9/1981 | Matson et al. | 75/105 |
| 4,298,379 | 11/1981 | Zambrano | 75/82 |
| 4,304,644 | 12/1981 | Victorovich et al. | 75/119 |
| 4,372,918 | 2/1983 | Woods et al. | 422/129 |
| 4,374,101 | 2/1983 | Lassiez et al. | 423/150 |
| 4,384,889 | 5/1983 | Wiewiorowski et al. | 75/101 R |
| 4,399,109 | 8/1983 | Iler et al. | 423/141 |
| 4,415,542 | 11/1983 | Queneau et al. | 423/141 |
| 4,423,011 | 12/1983 | Baglin et al. | 423/22 |
| 4,431,613 | 2/1984 | Verbaan | 423/22 |
| 4,436,702 | 3/1984 | Schulz et al. | 422/195 |
| 4,438,076 | 3/1984 | Pietsch et al. | 423/30 |
| 4,442,072 | 4/1984 | Baglin et al. | 423/22 |
| 4,501,721 | 2/1985 | Sherman et al. | 423/27 |
| 4,507,274 | 3/1985 | Broecker et al. | 423/573 R |
| 4,517,262 | 5/1985 | Beidler | 429/87 |
| 4,528,166 | 7/1985 | McDougall | 423/23 |
| 4,551,213 | 11/1985 | Wilson | 204/111 |
| 4,552,589 | 11/1985 | Mason et al. | 75/105 |
| 4,557,905 | 12/1985 | Sherman et al. | 423/27 |
| 4,559,209 | 12/1985 | Muir et al. | 423/30 |
| 4,571,263 | 2/1986 | Weir et al. | 75/101 R |
| 4,571,264 | 2/1986 | Weir et al. | 75/101 R |
| 4,578,163 | 3/1986 | Kunter et al. | 75/118 R |
| 4,587,110 | 5/1986 | Potter et al. | 423/30 |
| 4,592,779 | 6/1986 | Russ et al. | 75/101 R |
| 4,595,566 | 6/1986 | Byrd et al. | 422/134 |
| 4,595,572 | 6/1986 | Ogass et al. | 423/25 |
| 4,605,439 | 8/1986 | Weir | 75/118 R |
| 4,605,537 | 8/1986 | Touro | 423/29 |
| 4,606,763 | 8/1986 | Weir | 75/101 R |
| 4,606,766 | 9/1986 | Genik-Sas-Berezowsky et al. | 75/118 R |
| 4,610,724 | 9/1986 | Weir et al. | 75/118 R |
| 4,615,731 | 10/1986 | Thomas et al. | 75/97 A |
| 4,629,502 | 12/1986 | Sherman et al. | 75/118 R |
| 4,632,701 | 12/1986 | Genik-Sas-Berezowsky et al. | 75/118 R |
| 4,647,307 | 3/1987 | Raudsepp et al. | 75/118 R |
| 4,661,321 | 4/1987 | Byrd et al. | 422/111 |

PRECIOUS METALS RECOVERY FROM REFRACTORY CARBONATE ORES

FIELD OF THE INVENTION

This invention relates to a pressure oxidation process for liberating precious metal values from refractory, carbonate ores.

BACKGROUND

Many gold and silver-bearing ores are resistant to conventional cyanidation recovery procedures. These ores are commonly referred to as "refractory" ores. As used herein, the term "refractory ore" refers to an ore in which less than about 80 weight percent of the gold in the ore can be recovered by conventional cyanidation procedures.

Pretreatment of such refractory ores by pressure oxidation to make the ores more amenable to subsequent precious metal recovery is known. Operating conditions for a pressure oxidation process are generally disclosed by Hedley, et al. in U.S. Pat. No. 2,777,764 and U.S. Defensive Publication T104001 of Kunter, et al. A number of modifications of the pressure oxidation process have been reported. For example, Mason, et al. in U.S. Pat. No. 4,552,589 (1985) disclosed the alkaline pressure oxidation of a refractory ore slurry followed by cyanidation and precious metal extraction with activated charcoal. Weir in U.S. Pat. No. 4,606,763 (1986) disclosed a pressure oxidation process which used a first compartment having a specific size range to produce autogeneous oxidation of sulfidic materials.

A summary of the various methods of treating refractory gold ores is provided in a paper entitled "Process Options For The Treatment Of Refractory Gold Ores And Concentrates" by P.G. Mason and P.T. O'Kane, presented at the annual meeting Alberta/B.C. Branch Canadian Mineral Processors Vancouver, British Columbia, Nov. 29, 1985, incorporated herein by reference.

Refractory ores which contain high levels of carbonates present particular problems in recovering precious metals from such ores. As used herein, the term "carbonate" ore refers to a gold-bearing ore normally containing from about 0.05 to about 0.25 ounces of gold per ton, commonly small amounts of silver, and from about 1 to about 9 percent by weight total carbon. Most of the carbon present in the ore is in the form of inorganic carbon compounds, principally metal carbonates such as calcite and limestone. The carbonate content of the ore can range up to about 35 percent by weight (based on $CO_3$). The non-carbonate carbon content of the ore is usually less than 3 percent by weight.

The carbonate content of an ore is commonly determined by measuring carbon dioxide evolved. A typical procedure is described by E. Huffman, Jr. in "Performance of a New Automatic Carbon Dioxide Coulometer" in the Microchemical Journal, Vol. 22, pp. 567–573, 1977, incorporated herein by reference. These ores normally contain up to about 15 weight percent total sulfur primarily in the form of sulfides of iron, arsenic, and other metals. The sulfide content of an ore can be determined by any appropriate method, for example, that described by J.C. Ingles in "Manual of Analytical Methods for the Uranium Concentrating Plant", Dept. of Mines and Technical Surveys, Mines Branch, Ottawa, Monograph 866, incorporated herein by reference.

Some of the problems associated with the acid treatment of an ore which is high in carbonates is described in the paper entitled "Pressure Oxidation — A New Tool For Refractory Gold Ores And Concentrates" by L.S. Gormely and P.T. O'Kane, presented at the annual Alberta/British Columbia meeting, Canadian Mineral Processors Vancouver, British Columbia, Nov. 30, 1984. As described in this paper, the pressure oxidation under acidic conditions generates carbon dioxide gas which interferes with maintenance of the desired oxygen partial pressure in the oxidation system. In order to minimize the effect of the carbon dioxide production, it is disclosed that (a) a portion of the gas in the vapor space can be bled to prevent carbon dioxide build-up; (b) the ore can be preleached in sulfuric acid to reduce the carbon dioxide generation in the primary pressure oxidation process; or (c) the ore can be charged to the pressure oxidation process and a large tail gas stream can be recycled through an acid gas scrubber to remove the carbon dioxide. Individually, however, these procedures can result in significant economic penalties in loss of reactants and in added equipment.

Matson, et al. in U.S. Pat. No. 4,289,532 (1981) disclosed an oxidation process for treating carbonaceous ores using an oxidation step with oxygen followed by chlorination. The disclosed process requires the use of an alkaline pH medium. Due to the formation of acidic materials during the oxidation, alkaline material must be added to the process to maintain alkaline pH. This patent discloses that the use of acidic oxidation is unsuitable for treating calcium carbonate containing ores.

Weir, et al. in U.S. Pat. No. 4,571,263 (1986) disclosed a method for treating refractory auriferous sulfidic concentrates using pressure oxidation. The method involves pretreating the concentrate with aqueous sulfuric acid to decompose carbonate and acid consuming gange compounds before the pressure oxidation step. There is no suggestion in this patent of a process for the pressure oxidation of carbonate containing ore.

In view of the foregoing, it would be advantageous to have an acidic pressure oxidation process which minimizes consumption of sulfuric acid and oxygen while allowing substantial recovery of precious metals from the carbonate containing ore.

SUMMARY OF THE INVENTION

It has now been found that the desired advantages can be obtained with a process which involves adjusting the molar ratio of sulfide to total acid consumers in a feed ore to a pressure oxidation process to within a range necessary to provide at least about 5 grams of free sulfuric acid per liter of the oxidation slurry. The sulfide to total acid consumers molar ratio is adjusted to between about 1.2 and about 3.2. An aqueous slurry of this adjusted feed is contacted with oxygen in a first oxidation zone at a temperature of at least about 360° F. An oxidizing partial pressure of oxygen is maintained in the first oxidation zone. Ordinarily, this is a partial pressure of about 25 to about 150 psia. The feed is retained in this first oxidation zone until at least about 65 percent of the total sulfide oxidation achieved in the oxidation process is obtained and at least about 5 grams of free sulfuric acid per liter of slurry are present. The partially oxidized ore from the first oxidation zone is transferred through at least one subsequent oxidation zone where it is contacted with additional oxygen at a temperature in the range of about 360° F. to about 440° F. to form a final oxidized ore slurry. Gas from at least the first oxidation zone is removed and at least a portion of it is passed through a separation procedure in which carbon dioxide in the gas is separated from oxygen and the oxygen is recycled to the pressure oxidation process.

DETAILED DESCRIPTION OF THE PREFERRED EMBODIMENTS

Figure 1:
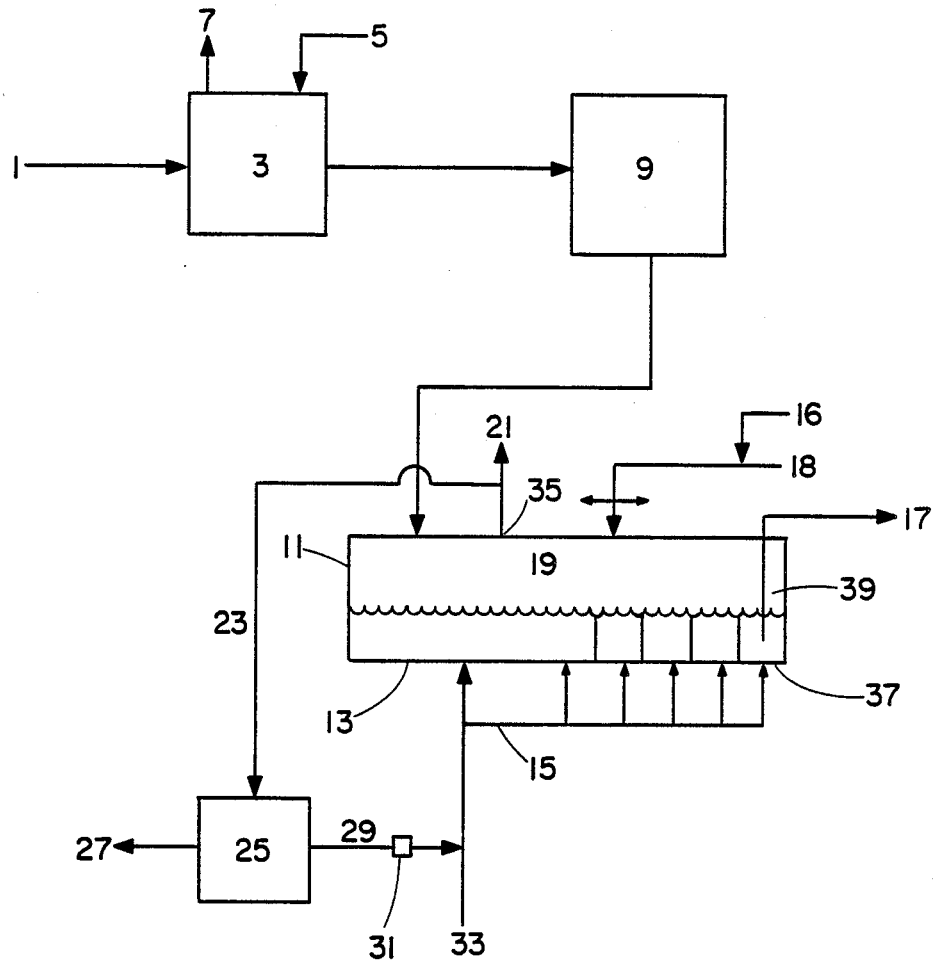
FIG. 1 depicts in schematic form a preferred embodiment of the present pressure oxidation process.

The present invention concerns a process for liberating precious metal values such as gold and silver from refractory ores containing inorganic sulfides and carbonates. It has now been found that improved recovery and significant reactant savings can be obtained by using a process which involves the steps of: (a) adjusting the molar ratio of sulfide to acid consumers of the ore feed to a pressure oxidation process to within a specific range; (b) accomplishing at least 65 percent of the pressure oxidation reaction in a first zone; (c) continuing the pressure oxidation in subsequent oxidation zones and recovering an oxidized slurry containing substantially liberated precious metals; and (d) removing vent gas from at least the first pressure oxidation zone, separating carbon dioxide from oxygen in the vent gas and recycling substantially pure oxygen to the pressure oxidation zones.

Although any sulfidic refractory ore can be used in the present process, it is contemplated that the instant process is most effective for a sulfur-containing ore which contains between about 0.1 and about 35, and preferably between about 2 and about 10 weight percent carbonate (based on $CO_3$) normally in the form of inorganic metal carbonates. Most of the sulfur in the ore is present as sulfide minerals which are commonly pyrite, realgar, orpiment and arsenopyrite, with minor amounts of chalcopyrite, pyrrhotite, sphalerite, galena, stibnite, cinnabar, and other commonly occurring sulfides. Opaque minerals can include hematite, magnetite and graphitic carbon. Non-opaque minerals can include quartz, calcite, limestone, kaolinite, illite, apatite, montmorillonite, gypsum, fluorite and barite.

As discussed hereinabove, a major problem which occurs in the acidic pressure oxidation of such ores is the consumption of acid by minerals such as calcite, limestone and various clays. The term "acid consumer" is used herein to refer to any material in the ore which reacts with sulfuric acid. A mole of such an acid consumer is defined herein to be that amount which reacts with (consumes) one mole of sulfuric acid. The "moles of total acid consumers" is the sum of the moles of all acid consumers present. As disclosed in the Kunter, et al. defensive publication and the Weir U.S. Pat. No. 4,571,263, the acidity should be maintained above about 5 grams per liter of free sulfuric acid in order for the pressure oxidation reaction to achieve the desired gold liberation. This has been accomplished in the past with preconditioning with sufficient acid to remove substantially all acid consumers prior to oxidation. This approach is not economical due to the consumption of fresh acid or the acid resistant equipment which is required if there is a recovery and recycle of acid in the pressure oxidation system.

It has now been found that by maintaining the molar ratio of sulfide to total acid consumers in the feed material to the pressure oxidation process within a particular range in conjunction with accomplishing at least about 65 percent of the oxidation in a first pressure oxidation zone and recycling oxygen, precious metals can be effectively liberated from the refractory ore while minimizing the costs associated with process reactants and equipment.

The mined ore is comminuted by conventional processing methods. For example, ore can be first crushed in a jaw crusher, cone crusher, or similar device. The crushed ore can then be further comminuted, for example, by grinding with water in a sag mill. The preferred particle size depends on how the sulfide is contained in the gangue and can be readily determined by those skilled in the art. Normally the particle size is in the range of about 80 percent passing 100 mesh to about 80 percent passing a 325 mesh sieve. Preferably, the particle size is in the range of about 80 percent passing a 200 mesh Tyler equivalent mesh screen.

The ore particles are normally segregated by particle size. This can be readily accomplished by slurrying the particles with water and passing the slurry through a segregating means, such as a cyclone. The segregated coarser particles can be further comminuted, for example, in a ball mill, while the ore particles in the desired size range proceed directly to the next stage in the process.

The water slurry of ore particles can be directed to a thickener in which flocculants are introduced in order to obtain the desired pulp density. Commonly used commercially available flocculants can be used, for example, non-ionic polyacrylamide containing materials such as "Percol 351" from Allied Colloids, "N3003" supplied by Alkaril Chemical Co. and "Superfloc 127" supplied by American Cyanamid. The preferred pulp density is between about 20 and about 60 weight percent solids. Preferably the feed slurry to the pressure oxidation process is maintained in the range of about 30 to about 45 weight percent solids. At lower pulp densities, the fluid properties allow improved mass transfer (gas to liquid or liquid to solid) so that over a significant range the increase in volume of the pressure oxidation system may be compensated for through the decrease in retention time required to obtain a desired level of oxidation.

It is important in achieving an efficient operation of the pressure oxidation process that the ratio of the moles of sulfide to the moles of total acid consumers be maintained within the range of about 1.2 to about 3.2 and preferably about 1.4 to about 1.7. Sulfide that is in the ore is oxidized with oxygen in the pressure oxidation reactor to generate sulfuric acid. For efficient operation, it is necessary that the quantity of sulfide be sufficient to generate at least 5 grams per liter of free sulfuric acid in the first oxidation zone of the pressure oxidation process. This "free sulfuric acid" is in addition to any sulfuric acid which is consumed by the acid consumers, such as the carbonates and clays, in the ore. Normally the carbonate and sulfide content of the as-mined ore varies considerably. Therefore, in normal operation quantities of the ore are blended in order to provide sufficient sulfide content to form at least about 5 grams of free sulfuric acid per liter of the oxidation slurry in the first oxidation zone.

As discussed hereinabove, carbonates normally comprise most of the acid consumers and can comprise 90 mole percent of the total acid consumers. The total sulfur level in the ore can commonly range between about 1 and about 15 weight percent. The ore is preferably blended to provide a maximum of about 5 weight percent sulfide in the material to be fed to the pressure oxidation process. Since the level of carbonates in the ore can range from about 2 to about 10 weight percent (based on $CO_3$), the carbonate content of the blend can be adjusted as necessary to achieve the desired mole ratio of sulfide to total acid consumers in the pressure oxidation feed. This molar ratio should be between about 1.2 and about 3.2 (sulfide to total acid consumers). While it would be preferred to obtain such a ratio by blending the ore feedstock, in practice this cannot be readily achieved because of the large variations in the composition of the ore and the time required to obtain the necessary analyses. Therefore, in practice it is normally necessary to adjust this ratio in the conditioning zone of the instant process.

A preferred process scheme is depicted in FIG. 1. A feed slurry 1 is transferred to a conditioning zone 3 where the molar ratio of sulfide to acid consumers is adjusted as necessary to obtain the desired range before introduction of the feed to the pressure oxidation process. The conditioning zone can contain one or more conditioning vessels which are normally agitated to provide adequate mixing of the components and avoid settling of the ore particles. Depending upon the desired residence time and through-put, the conditioning zone can comprise one or more vessels which are connected in series or in parallel. Sulfuric acid 5, preferably in the form of 93 percent sulfuric acid, is added to the slurry in the conditioning zone to obtain a pH in the range of about 2 to about 7, preferably in the range of about 5 to about 6. The amount of sulfuric acid which must be added depends upon the amount of sulfide and carbonate in addition to other acid consumers present in the feed ore. The higher the level of acid consumers present relative to the sulfide content, the greater the amount of conditioning, i.e. sulfuric acid addition, which is required to reduce the level of acid consumers. The level of acid present in the conditioning zone is preferably controlled by monitoring the amount of free sulfuric acid exiting the final pressure oxidation zone. Fresh sulfuric acid is added to the conditioning zone to maintain a free acid level of at least about 10 grams per liter of oxidation slurry liquid exiting the final oxidation zone. Sulfuric acid is consumed by reaction with the carbonate to produce carbon dioxide as well as reaction with other acid consumers in the ore, such as certain clays. Sufficient sulfuric acid is introduced in the conditioning zone to obtain the necessary molar ratio of sulfide to acid consumers of between about 1.2 and about 3.2.

The feed slurry ordinarily enters the conditioning zone at ambient temperature. The reaction between sulfuric acid and the acid consumers is exothermic and consequently the temperature of the slurry in the conditioning zone increases. No heat is added in addition to that from the exothermic reactions occurring in the conditioning zone. The temperature of the slurry exiting the conditioning zone can range up to a maximum of about 165° F. Normally the exit temperature of the slurry is in the range of about 100° F. to about 120° F. To obtain the desired level of reaction among the carbonates, the other acid consumers, and the sulfuric acid, a residence time in the range of about 1 to 3 hours has been found to be sufficient, with a residence time in the range of about 1.5 to about 2.5 hours being preferred. Carbon dioxide is generated by the reaction between sulfuric acid and inorganic carbonates. Air is normally pumped through the slurry in order to maintain a slightly oxidizing atmosphere and aid in purging the carbon dioxide formed in the reaction. The vapor phase is vented, 7, from the conditioning zone.

The conditioned slurry containing the ore whose molar ratio of sulfide to acid consumers has been adjusted to the desired range ("adjusted ore") is transferred from the conditioning zone preferably to a preheating zone 9 where the slurry is heated. This can be accomplished by direct injection of steam or by indirect heat exchange. The slurry is heated to a temperature within the range effective for introduction to the pressure oxidation process. Normally the temperature is in the range of about 200° F. to 350° F., and preferably in the range of about 260° F. to about 300° F. Any device suitable for providing the desired heat exchange can be used, for example, splash condensors. It is also contemplated that multiple vessels can be used in series to provide the desired temperature increase of the slurry. Pressure is maintained in the preheating zone as necessary to maintain the water in liquid phase, normally in the range of about 0 pounds per square inch gauge (psig) to about 120 psig, preferably 25 psig to 70 psig.

The heated slurry is transferred from the preheating zone to a pressure oxidation process. The pressure oxidation process uses multiple oxidation zones to obtain the desired level of oxidation to liberate the precious metal values. It is contemplated that the pressure oxidation process can be conducted in a reactor system of interconnected individual vessels or preferably, as depicted in FIG. 1, a single autoclave 11 having multiple compartments. It is also contemplated that more than one pressure reactor system can be arranged in parallel with each having the necessary multiple zones. Such an arrangement can be used to increase the overall through-put of ore through the oxidation process.

In the pressure oxidation process, sulfide is oxidized in an exothermic reaction to principally form sulfuric acid. The sulfuric acid formed reacts with the carbonates and other acid consumers in the ore. The combination of these reactions allows the gold and silver values to be subsequently separated and recovered from the reaction mixture.

It has now been found that with sulfidic ores the recovery of precious metal values can be increased, while the use of sulfuric acid and associated acid costs can be minimized by allowing at least about 65 percent of the total sulfide oxidation reaction which occurs to occur in a first pressure oxidation zone 13. This extent of oxidation reaction is based upon the total amount of sulfide in the ore which is oxidized in all of the oxidation zones, e.g. if 90% of all sulfide present in the ore is oxidized before exiting the oxidation zones, then at least 58.5% of all the sulfide is oxidized in the first zone. This is accomplished with a large first zone in order to maximize back-mixing. Multiple subsequential oxidation zones are used to minimize bypass of ore through the oxidation stage. Although use of a single pressure oxidation zone would serve to minimize acid cost, the efficiency of the sulfide oxidation would be reduced and there would be a corresponding reduction in recovery of precious metals. Therefore, to maximize back-mixing and minimize bypass or pass-through of unreacted ore, at least about 65 percent, and most preferably at least about 70 percent, of the pressure oxidation reaction of sulfide which occurs is conducted in the first zone. To accomplish this degree of conversion, it is preferred that at least 50 volume percent of the total volume of all the slurry contained in all the oxidation zones be contained in the first oxidation zone. The number of subsequent oxidation zones depends upon the efficiency of precious metals recovery desired. The number of subsequent zones can range from one to more than ten. To maximize the efficiency without unduly increasing equipment costs, it is preferred that there be at least four but no more than eight subsequent oxidation zones. Most preferably, four or five oxidation zones follow the first pressure oxidation zone.

Although oxygen can be added to the vapor space above the slurry, oxygen is preferably introduced 15 to the agitated slurry in each oxidation zone to maximize the rate of the oxidation reaction. It is preferred to use commercially pure oxygen which contains preferably at least about 95 volume percent oxygen, and more preferably at least about 98 volume percent oxygen to minimize the volume of vapor which must be vented. To obtain the desired oxidation rate, it is also necessary to maintain an oxygen partial pressure in the pressure oxidation zones of at least about 50 psia. Ordinarily the partial pressure of oxygen is between about 25 psia and about 150 psia and preferably between about 80 psia and about 120 psia. Typically, the total pressure in the pressure oxidation zones is between about 300 psia and about 500 psia.

The temperature of the slurry in the pressure oxidation zones is critical for effective oxidation of the ore. It is preferred that the slurry temperature in the first oxidation zone be greater than about 360° F., preferably in the range of about 360° F. to about 440° F., and it is most preferred that the temperature be in the range of about 400° F. to about 420° F. It is also preferred that the slurry temperature in the other oxidation zones be in the same range. With an oxidation temperature in this range, a nominal residence time of ore in the oxidation process is about 1 to about 2 hours.

As indicated hereinabove, the oxidation of the sulfidic components in the ore is an exothermic reaction which forms sulfuric acid. To maximize recovery of the precious metals, it has been found that at least about 5 grams of free sulfuric acid per liter of reaction slurry should be present in the first pressure oxidation zone. This free acid is in excess of that acid necessary to react with the acid consumables in the ore, such as carbonates and clays. The amount of free sulfuric acid present normally increases as the slurry passes through the subsequent pressure oxidation zones. The oxidized slurry 17 exiting the pressure oxidation process preferably contains between about 10 grams and 30 grams of free sulfuric acid per liter of slurry and most preferably about 12 to about 15 grams per liter. Free acid content of the slurry can be determined by any convenient method, for example, by titration with sodium hydroxide to a pH end point of 7.3.

If there is sufficient sulfide in the feed, it is not necessary to add additional heat to the first oxidation zone since the oxidation reaction of the sulfides is exothermic. When the sulfide level in the feed is high, e.g. above about 5 weight percent of the solid feed, it may be necessary to cool the first zone by adding cooled water. It is contemplated, however, that if the sulfide level of the ore is less than about 3 weight percent or if there is excessive heat loss from the pressure oxidation system, it may be necessary to add heat to the pressure oxidation slurry. This is normally accomplished by injecting steam 16 into the slurry. It is preferred that a substantially constant oxidation temperature be maintained in the oxidation zones. Because the oxidation reaction is exothermic, it is normally necessary to cool the slurry in those oxidation zones following the first zone in order to maintain the temperature. This can be conveniently accomplished by adding cooled water 18 to the zones as necessary.

As set forth hereinabove, the reaction between sulfuric acid and carbonates in the ore generates carbon dioxide. Therefore, the gas phase 19 in the pressure oxidation zones include oxygen, nitrogen, carbon dioxide, and water vapor. Also as indicated hereinabove, the partial pressure of oxygen is critical in order to maintain the desired rate of reaction. Since carbon dioxide continues to build up in the gas phase, it is necessary to vent gas from the pressure oxidation zones. A preferred method of operation is depicted in FIG. 1 in which vapor is removed and a small bleed 21 can be vented to control inerts, such as nitrogen, in the system. Alternatively, such inerts can be carried through, separated from oxygen and removed with the carbon dioxide.

The bulk of the gas is transferred 23 to a carbon dioxide removal zone 25 where carbon dioxide 27 is separated from oxygen. This separation is necessary when treating carbonate ores in order to recover oxygen vented from the system and minimize oxygen cost. Any of the known methods for separating carbon dioxide from the oxygen stream can be used. These methods include chemical reaction and physical absorption processes which can remove the carbon dioxide and are compatible with oxygen. Examples of such processes include absorption with water, dilute solvents (e.g., propylene glycol) or activated hot potassium carbonate. A preferred method involves first cooling the gas to between about 200° F. and about 300° F. The gas is then contacted with lean hot potassium carbonate solution at a temperature of between about 200° F. and about 300° F. to absorb the carbon dioxide. The oxygen-rich gas 29 is then compressed 31 and combined with a fresh oxygen stream 33 before being recycled to the oxidation zones. The carbon dioxide is removed (not shown) from the carbon dioxide-rich solution by flashing to a lower pressure and steam stripping in a stripping tower. The regenerated lean absorbant solution is then recycled back to the removal zone 25.

The gas phase containing oxygen, carbon dioxide and other gases is removed from each of the pressure oxidation zones if these are contained in separate vessels or, as represented in FIG. 1, can be removed from one location 35 if a single autoclave is used. In another embodiment of the instant process, gas from the first reaction zone is passed into the carbon dioxide separation zone while gas from subsequent oxidation zones is introduced into the oxygen feed loop. This can be accomplished since most of the carbon dioxide is generated in the first pressure oxidation zone. This procedure minimizes the volume of gases which must be passed through the carbon dioxide separation zone.

The oxidized slurry from the pressure oxidation process is removed from the final oxidation zone. As indicated hereinabove, it is preferred that there be at least about 10 grams per liter of free sulfuric acid in the oxidized slurry from the final zone. This can be determined by conventional quantitative analysis, for example, by titration with sodium hydroxide as indicated above. However, it is also convenient to measure the electromotive force (EMF) of the slurry. This can be accomplished, for example, by using a standard calomel electrode with reference to a platinum electrode calibrated against a standard solution. It is preferred that the EMF of the oxidized slurry product be between about 450 and about 650 millivolts, and preferably at least about 500 millivolts. If the measured EMF is less than about 500 millivolts, it indicates that there is insufficient oxidation reaction occurring in the pressure oxidation zones. Therefore, one or more of the following variables can be increased: the retention time of the slurry in the first zone or the overall oxidation process retention time; the slurry temperature in the pressure oxidation zones; or the amount of oxygen added to the first zone and possibly later zones. It is contemplated that more than one of these parameters can be adjusted to achieve the desired level of oxidation in the oxidation process. The required balance between these parameters can be readily determined by a person skilled in the art with the above-described guidelines.

The oxidized slurry can be removed from the terminal oxidation zone 37 by any means commonly used to handle pressurized slurries. This can include the use of a a dip leg device 39, as depicted in FIG. 1, and a ceramic choke valve.

The precious metal values can be recovered from the oxidized slurry by any of the known conventional processes. Preferably the oxidized pulp is neutralized and then is subjected to cyanidation followed by adsorption of the metal values from the leached pulp onto activated charcoal. The precious metals are then stripped from the activated charcoal and recovered by electrowinning or by precipitation with zinc and refining.

Figure 2:
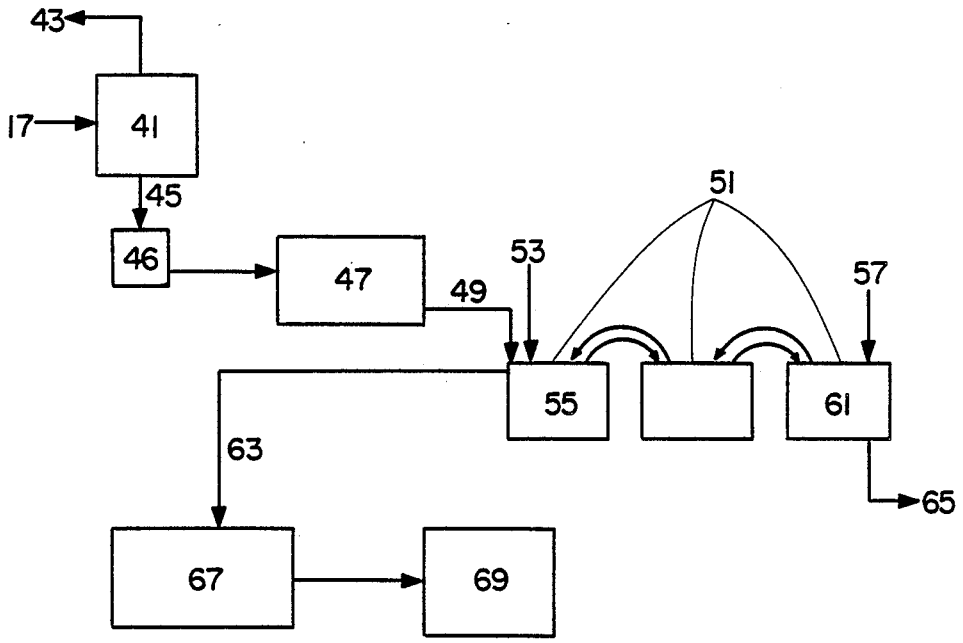
FIG. 2 depicts in schematic form a preferred method for recovering precious metals from an oxidized ore slurry.

A preferred process is depicted in FIG. 2 in which the oxidized slurry 17 having a solids content of about 20 to about 50 weight percent is transferred to a flash zone 41. Steam 43 is flashed from the slurry and is commonly recycled for use in the preheating zones or in other locations where heat duty is required. The cooled slurry from the flash zone has a temperature preferably less than 210° F. and is conducted 45 to slurry coolers 46 to cool the slurry to below about 150° F., preferably below about 120° F. The cooled slurry is then transferred to a neutralization zone 47.

The neutralization zone 47 normally comprises a plurality of stages in which the pH of the entering oxidized slurry is increased from a pH of less than about 1, for the slurry entering the neutralization zone, to a pH of greater than about 9 for the slurry exiting the neutralization zone. The entering oxidized slurry is contacted with an alkaline material, such as lime or limestone, preferably with agitation. As the slurry is conducted through the stages of the neutralization zone, additional neutralizing agent is added along with water so that the viscosity of the neutralized slurry is suitable for subsequent processing. Normally two to six stages are used in the neutralization zone preferably with limestone added initially and a lime slurry added to the later stages.

The product from the neutralization zone having a pH above about 9, and preferably having a pH of between about 10 and about 11, is subjected to cyanidation to allow subsequent separation and recovery of the precious metals. This recovery can be accomplished by any of the known processes, such as the "carbon-in-pulp" process described by Kunter, et al. in U.S. Pat. No. 4,578,163, incorporated herein by reference. If required, heavy metals can be separated as described by Kunter, et al. A "carbon-in-leach" process using granular activated-charcoal is preferred such as that described by Matson, et al. in U.S. Pat. No. 4,289,532, incorporated herein by reference.

In a preferred process, the slurry from the neutralization zone having a pH above about 9 is transferred 49 to the cyanidation/carbon-in-leach zone 51. In this zone, simultaneous cyanidation and granular activated charcoal adsorption of precious metal values is conducted. This process is normally conducted in a plurality of stages. In practice, the neutralized slurry is contacted with a cyanide solution, commonly an aqueous solution of sodium cyanide, to provide a cyanide content in the slurry in the range of about 0.05 to 0.2 weight percent of the liquid phase of the slurry (based on sodium cyanide). The slurry is simultaneously contacted with granular activated charcoal in which the charcoal is moving counter-current to the flow of the slurry. Lime can be added as necessary to maintain the pH between about 10 and about 11 to minimize cyanide decomposition.

A cyanidation/carbon-in-leach zone having three stages is depicted in FIG. 2. The cyanide solution 53 is added to the first stage 55 along with the slurry 49 from the neutralization zone. Fresh activated charcoal 57 is added to the third stage 61 and counter-current flow is established transferring the activated charcoal ultimately to the first stage. The activated charcoal becomes loaded with precious metals as it is transferred counter-current to the flow of the cyanide containing slurry. The charcoal loaded with precious metals is then removed 63 from the first stage in the cyanidation/carbon-in-leach zone. Tailings 65 are removed from the final stage 61.

Any type of commonly available granular activated charcoal can be used. Its particle size should be substantially larger than the particle size of the ore pulp being treated to allow for an efficient separation of the two by a separation method based on particle size, such as screening. The concentration of activated charcoal in each carbon-in-leach zone is normally at least about 100 pounds of activated charcoal per 1,000 gallons of slurry.

The loaded carbon stream is then subjected to metals recovery by conventional means in a metals stripping zone 67. One method involves contacting the loaded charcoal with a sodium hydroxide-cyanide solution under a pressure of about 70 psia at about 300° F. Another such method involves stripping with hot sodium hydroxide-ethanol-cyanide solution in columns which are packed with the loaded carbon. The hot sodium hydroxide-ethanol-cyanide solution is circulated past the carbon to remove the precious metals from the carbon. The removed metals which are dissolved in the liquid can then be sent to an electrowinning operation 69 where the metals are recovered by electrolytic deposition. Another method of precious metals recovery from solution involves precipitation of the metals with zinc. Various processes are described in the Kunter patent, U.S. Pat. No. 4,578,163, which has been incorporated herein by reference.

The following examples are intended by way of illustration and not by way of limitation.

EXAMPLE 1

Samples of gold-containing carbonate ores from various locations were subjected to a batch pressure oxidation procedure. In this procedure, ore samples were first ground to about 85 weight percent having a particle size minus 74 microns. The amount of ground ore particles necessary to provide the slurry were pulped with fresh water, i.e. 250g, 400g, and 500g for 20%, 30%, and 40% slurries respectively. The slurry was conditioned with varying amounts of 93% sulfuric acid. The amount of sulfuric acid used ranged from about 0 to about 60 grams with the specific amount chosen to give the free acid level indicated in Table 1 for the particular Run. The resulting slurry was then transferred to a 2 liter Parr autoclave and preheated to the desired testing temperature of about 195° C. to about 210° C. After the slurry reached the desired temperature, oxygen gas was introduced into the system until the desired total pressure was obtained. A flow rate was set to maintain a minimum of 50% oxygen in the exhaust gas mixture. Once the oxygen content reached 95% or higher, the offgas flow was adjusted to 300 ml/min. and the total pressure was reduced to maintain the desired partial pressure of oxygen. The total time of the pressure oxidation was approximately 90 minutes. The oxidized slurry was then cooled with water; the pH was adjusted to 10.5; sodium cyanide was added to provide a concentration of 0.5 grams per liter (g/l); and activated charcoal was added to provide a concentration of 10 g/l. Conditions, compositions and results of batch runs are given in Tables 1 and 2.

TABLE 1

| Run | Grind %-325# | Solids wt % | Temp °C. | Total psi | $O_2$ psi | Time min. | Free Acid g/l | Extraction wt % |
|---|---|---|---|---|---|---|---|---|
| 1 | 80 | 40 | 210 | 460–330 | 100 | 90 | 0.0 | 65.1 |
| 2 | 80 | 30 | 210 | 460–330 | 100 | 90 | 9.5 | 74.8 |
| 3 | 80 | 40 | 210 | 460–330 | 100 | 90 | 12.9 | 79.8 |
| 4 | 80 | 40 | 210 | 460–360 | 100 | 90 | 10.2 | 82.5 |
| 5 | 80 | 40 | 210 | 460–360 | 100 | 90 | 16.4 | 95.0 |
| 6 | 80 | 40 | 210 | 460–360 | 100 | 90 | 26.6 | 95.5 |
| 7 | 80 | 40 | 210 | 460–360 | 100 | 90 | 28.9 | 92.2 |
| 8 | 65 | 40 | 210 | 460 | — | 90 | 17.5 | 89.1 |
| 9 | 65 | 40 | 210 | 460 | — | 90 | 25.0 | 91.0 |
| 10 | 65 | 40 | 210 | 460 | — | 90 | 38.9 | 92.3 |
| 11 | 40 | 40 | 210 | 460 | — | 90 | 27.8 | 90.4 |
| 12 | 50 | 40 | 210 | 460 | — | 90 | 23.3 | 93.6 |
| 13 | 65 | 40 | 210 | 370 | — | 90 | 29.4 | 94.9 |
| 14 | 65 | 40 | 210 | 420 | — | 90 | 31.4 | 95.5 |
| 15 | 65 | 40 | 210 | 470 | — | 90 | 28.1 | 95.5 |
| 16 | — | 40 | 210 | 460 | — | 90 | — | 93.6 |
| 17 | 97 | 20 | 200 | 325 | 100 | 90 | 8.8 | 86.6 |
| 18 | 97 | 20 | 200 | 325 | 100 | 240 | 3.2 | 79.3 |
| 19 | 97 | 20 | 200 | 325 | 100 | 240 | 25.2 | 93.0 |
| 20 | 97 | 20 | 200 | 325 | 100 | 240 | 15.0 | 95.2 |
| 21 | 81 | 20 | 150 | 119 | 50 | 30 | 17.1 | 81.7 |
| 22 | 81 | 20 | 150 | 229 | 150 | 30 | 10.7 | 86.9 |
| 23 | 81 | 20 | 210 | 426 | 150 | 30 | 20.0 | 94.6 |
| 24 | 90 | 20 | 200 | 325 | 100 | 240 | 16.7 | 92.6 |
| 25 | 84 | 20 | 210 | 325 | 50 | 30 | 18.7 | 93.2 |
| 26 | 84 | 20 | 210 | 430 | 150 | 30 | 18.2 | 94.5 |
| 27 | 84 | 20 | 150 | 120 | 50 | 150 | 12.6 | 89.9 |
| 28 | 84 | 20 | 150 | 230 | 150 | 150 | 11.4 | 93.0 |
| 29 | 84 | 20 | 180 | 250 | 100 | 90 | 10.6 | 92.9 |
| 30 | 87 | 20 | 210 | 325 | 50 | 90 | 25.0 | 85.1 |
| 31 | 87 | 20 | 210 | 325 | 50 | 90 | 30.0 | 90.5 |

TABLE 2

| Runs | S % | $CO_2$ % | C (org.) % | Au % | As % | Fe % | Hg ppm | Sb ppm |
|---|---|---|---|---|---|---|---|---|
| 1–7 | 3.08 | 4.06 | 0.54 | 0.114 | 2.31 | 2.90 | 72 | — |
| 8–15 | 2.85 | 4.04 | — | 0.162 | 3.76 | 2.52 | 103 | — |
| 16 | 2.84 | 3.80 | — | 0.164 | 3.77 | 2.58 | 103 | — |
| 17–23 | 3.6 | 2.45 | 0.57 | 0.123 | 2.34 | 2.91 | 95 | 400 |
| 24 | 4.28 | 5.29 | 1.13 | 0.388 | 5.18 | 3.08 | 78 | 110 |
| 25–29 | 4.11 | 2.65 | 0.32 | 0.141 | 2. | 3.79 | 78 | 350 |
| 30–31 | 4.91 | 3.54 | 0.13 | 0.204 | 5.13 | 2.83 | 78 | 1100 |

EXAMPLE 2

A semi-continuous procedure was used to measure the effects of process variables including free acid concentration. In the semi-continuous runs, a sample bomb was attached to the inlet gas pipe of a 2-liter Parr autoclave to allow injection or removal of sample slurry during the leaching. A 1-hour batch procedure, as described in Example 1, preceded the semi-continuous procedure. Thereafter, 75 ml. to 150 ml. of leached slurry were removed through the sample bomb and immediately replaced with the same amount of fresh slurry at fixed intervals of 9 or 10 minutes. Measurements of pH, EMF and free acid were taken on each slurry sample removed from the autoclave. The run was terminated when the pH, EMF and free acid levels had stabilized, which generally occurred with two complete volume replacements. The final oxidized slurry and a few of the intermediate slurry samples were subjected to standard cyanidation processes. Conditions and results of the semi-continuous runs are given in Tables 3 and 4 below.

TABLE 3

| Run | Solids wt % | Temp °C. | Total psi | $O_2$ psi | Time min. | Free Acid g/l | Extraction wt % |
|---|---|---|---|---|---|---|---|
| 32 | 40 | 210 | 460 | 100 | 250 | 14.8 | 92.9 |
| 33 | 40 | 210 | 460 | 100 | 125 | 10.8 | 93.7 |
| 34 | 40 | 210 | 460 | 100 | 125 | 4.5 | 83.7 |
| 35 | 40 | 210 | 460 | 100 | 125 | 3.2 | 84.8 |
| 36 | 40 | 210 | 460 | 100 | 113 | 8.6 | 88.6 |
| 37 | 40 | 210 | 460 | 100 | 113 | 10.6 | 89.5 |
| 38 | 40 | 210 | 460 | 100 | 113 | 14.2 | 94.2 |
| 39 | 40 | 195 | 400 | 100 | 113 | 12.6 | 90.6 |
| 40 | 33 | 210 | 460 | 100 | 63 | 10.8 | 91.5 |
| 41 | 40 | 210 | 460 | 100 | 63 | 14.1 | 90.5 |
| 42 | 40 | 210 | 460 | 100 | 113 | 12.6 | 93.5 |
| 43 | 40 | 210 | 560 | 200 | 113 | 13.4 | 93.6 |
| 44 | 40 | 210 | 560 | 200 | 63 | 13.8 | 90.3 |
| 45 | 40 | 210 | 460 | 100 | 113 | 13.4 | 91.3 |

TABLE 3-continued

| Run | Solids wt % | Temp °C. | Total psi | $O_2$ psi | Time min. | Free Acid g/l | Extraction wt % |
|---|---|---|---|---|---|---|---|
| 46 | 40 | 210 | 460 | 100 | 113 | 12.4 | 91.1 |
| 47 | 40 | 210 | 460 | 100 | 113 | 14.7 | 91.8 |
| 48 | 40 | 210 | 460 | 100 | 113 | 10.8 | 92.4 |

TABLE 4

| | Semi-Continuous Test Compositions | | | | | | |
|---|---|---|---|---|---|---|---|
| Runs | S % | $CO_2$ % | C (org.) % | Au % | As % | Fe % | Hg ppm |
| 32–34 | 3.08 | 4.06 | 0.54 | 0.114 | 2.31 | 2.90 | 72 |
| 35–47 | 2.77 | 4.07 | 0.64 | 0.116 | 2.15 | 2.85 | 71 |
| 48 | 3.04 | 4.59 | 0.49 | 0.112 | 2.31 | 3.15 | 70 |

While various embodiments of the present invention have been described in detail, it is apparent that modifications and adaptations of those embodiments will occur to those skilled in the art. However, it is to be expressly understood that such modifications and adaptations are within the spirit and scope of the present invention as set forth in the following claims.

What is claimed is:

1. A method for liberating precious metal values from refractory carbonate ores which contain inorganic sulfides and acid consumers, said method comprising:

(a) adjusting a molar ratio of sulfide to total acid consumers to within a range of about 1.2 to about 3.2 to provide an adjusted ore feed, wherein said molar ratio of sulfide to total acid consumers is adjusted by contacting said ore feed with sulfuric acid to convert carbonate to carbon dioxide; and (b) contacting an aqueous slurry of said adjusted ore feed with oxygen at a slurry temperature of at least about 360° F. in a first oxidation zone and at least one subsequent oxidation zone, each of said oxidation zones having a slurry phase and a gas phase, to form a final oxidized pulp slurry and convert at least a portion of said sulfide to sulfuric acid wherein at least about 65 percent of said conversion occurs in the first oxidation zone, wherein sulfuric acid is generated in an amount sufficient to react with said acid consumers and also form at least about 5 grams of free sulfuric acid per liter of slurry in said first oxidation zone.

2. A method for liberating precious metal values from refractory carbonate ores which contain inorganic sulfides and acid consumers, said method comprising:

(a) adjusting a molar ratio of sulfide to total acid consumers to within a range of about 1.2 to about 3.2 to provide an adjusted ore feed; and (b) contacting an aqueous slurry of said adjusted ore feed with oxygen at a slurry temperature of at least about 360° F. in a first oxidation zone and at least one subsequent oxidation zone, each of said oxidation zones having a slurry phase and a gas phase, to form a final oxidized pulp slurry and convert at least a portion of said sulfide to sulfuric acid wherein at least about 65 percent of said conversion occurs in the first oxidation zone, wherein sulfuric acid is generated in an amount sufficient to react with said acid consumers and also form at least about 5 grams of free sulfuric acid per liter of slurry in said first oxidation zone, and wherein said final oxidized pulp slurry has an EMF of at least about 500 millivolts.

3. A method for liberating precious metal values from refractory carbonate ores which contain inorganic sulfides and acid consumers, said method comprising:

(a) adjusting a molar ratio of sulfide to total acid consumers to within a range of about 1.2 to about 3.2 to provide an adjusted ore feed; and (b) contacting an aqueous slurry of said adjusted ore feed with oxygen at a slurry temperature of at least about 360° F. in a first oxidation zone and at least one subsequent oxidation zone, each of said oxidation zones having a slurry phase and a gas phase, to form a final oxidized pulp slurry and convert at least a portion of said sulfide to sulfuric acid wherein at least about 65 percent of said conversion occurs in the first oxidation zone, wherein sulfuric acid is generated in an amount sufficient to react with said acid consumers and also form at least about 5 grams of free sulfuric acid per liter of slurry in said first oxidation zone, and wherein said final oxidized pulp slurry contains at least about 10 grams of free sulfuric acid per liter.

4. A method for liberating precious metal values from refractory carbonate ores which contain inorganic sulfides and acid consumers, said method comprising:

(a) adjusting a molar ratio of sulfide to total acid consumers to within a range of about 1.2 to about 3.2 to provide an adjusted ore feed; and (b) contacting an aqueous slurry of said adjusted ore feed with oxygen at a slurry temperature of at least about 360° F. in a first oxidation zone and at least one subsequent oxidation zone, each of said oxidation zones having a slurry phase and a gas phase, to form a final oxidized pulp slurry and convert at least a portion of said sulfide to sulfuric acid wherein at least about 70 percent of said conversion of sulfide occurs in said first oxidation zone, wherein sulfuric acid is generated in an amount sufficient to react with said acid consumers and also form at least about 5 grams of free sulfuric acid per liter of slurry in said first oxidation zone.

5. A method for liberating precious metal values from refractory carbonate ores which contain inorganic sulfides and acid consumers, said method comprising:

(a) adjusting a molar ratio of sulfide to total acid consumers to within a range of about 1.2 to about 3.2 to provide an adjusted ore feed;

(b) contacting an aqueous slurry of said adjusted ore feed with oxygen at a slurry temperature of at least about 360° F. in a first oxidation zone and at least one subsequent oxidation zone, each of said oxidation zones having a slurry phase and a gas phase, to form a final oxidized pulp slurry and convert at least a portion of said sulfide to sulfuric acid wherein at least about 65 percent of said conversion occurs in the first oxidation zone, and wherein sulfuric acid is generated in an amount sufficient to react with said acid consumers and also form at least about 5 grams of free sulfuric acid per liter of slurry in said first oxidation zone; and (c) contacting said final oxidized pulp slurry with an alkaline solution containing cyanide to solubilize precious metal values, wherein said solubilized metal values are adsorbed on activated charcoal, said charcoal is separated from said pulp, and said metal values are then stripped from said charcoal and recovered.

6. A method for liberating precious metal values from refractory carbonate ores which contain inorganic sulfides and acid consumers, said method comprising:

(a) adjusting a molar ratio of sulfide to total acid consumers to within a range of between about 1.4 and about 1.7 to provide an adjusted ore feed; and (b) contacting an aqueous slurry of said adjusted ore feed with oxygen at a slurry temperature of at least about 360° F. in a first oxidation zone and at least one subsequent oxidation zone, each of said oxidation zones having a slurry phase and a gas phase, to form a final oxidized pulp slurry and convert at least a portion of said sulfide to sulfuric acid wherein at least about 65 percent of said conversion occurs in the first oxidation zone, wherein sulfuric acid is generated in an amount sufficient to react with said acid consumers and also form at least about 5 grams of free sulfuric acid per liter of slurry in said first oxidation zone.

7. A method for liberating precious metal values from refractory carbonate ores which contain inorganic sulfides and acid consumers, said method comprising:

(a) adjusting a molar ratio of sulfide to total acid consumers to within a range of about 1.2 to about 3.2 to provide an adjusted ore feed, wherein at least about 90 mole percent of said acid consumers is carbonate; and (b) contacting an aqueous slurry of said adjusted ore feed with oxygen at a slurry temperature of at least about 360° F. in a first oxidation zone and at least one subsequent oxidation zone, each of said oxidation zones having a slurry phase and a gas phase, to form a final oxidized pulp slurry and convert at least a portion of said sulfide to sulfuric acid wherein at least about 65 percent of said conversion occurs in the first oxidation zone and wherein sulfuric acid is generated in an amount sufficient to react with said acid consumers and also form at least about 5 grams of free sulfuric acid per liter of slurry in said first oxidation zone.

8. A method for liberating precious metal values from refractory carbonate ores which contain inorganic sulfides and acid consumers, said method comprising:

(a) adjusting a molar ratio of sulfide to total acid consumers to within a range of about 1.2 to about 3.2 to provide an adjusted ore feed; and (b) contacting an aqueous slurry of said adjusted ore feed with oxygen in a first oxidation zone and at least one subsequent oxidation zone, each of said oxidation zones having a slurry phase and a gas phase, to form a final oxidized pulp slurry and convert at least a portion of said sulfide to sulfuric acid wherein at least about 65 percent of said conversion occurs in the first oxidation zone, wherein sulfuric acid is generated in an amount sufficient to react with said acid consumers and also form at least about 5 grams of free sulfuric acid per liter of slurry in said first oxidation zone, and wherein the slurry in said oxidation zones is between about 360° F. and about 440° F., said oxygen is present in said gas phase with a partial pressure of at least 25 psia, and the total gas pressure in said first oxidation zone is about 300 to about 500 psia.

9. The method of claim 8 wherein the temperature in said oxidation zones is between about 400° F. and about 420° F. and the partial pressure of said oxygen is at least about 80 psia.

10. A method for liberating gold and silver present in refractory carbonate ores, said method comprising:

(a) adding sufficient sulfuric acid to a water slurry containing particlized ore to convert a portion of inorganic carbonates in said ore to carbon dioxide and react with other acid consumers in said ore to provide a slurry of pretreated ore having a molar ratio of sulfide to total acid consumers in said pretreated ore of between about 1.2 and about 3.2;

(b) heating said slurry of pretreated ore pulp to a temperature of at least about 260° F. to provide a heated pulp slurry;

(c) subjecting said heated pulp slurry to a pressure oxidation process in which said slurry is added to a first oxidation zone and is then passed sequentially through at least four subsequent oxidation zones wherein at least 50 volume percent of the total volume of all the slurry contained in all the oxidation zones is contained in the first oxidation zone, wherein each oxidation zone has a gas phase and a slurry phase in which at least a portion of the sulfide in said pulp is oxidized to sulfuric acid by introducing oxygen into said slurry to provide an oxygen partial pressure of at least about 25 psia in a gas phase above said slurry;

(d) maintaining said pulp in said first oxidation zone to allow at least about 65 percent of the sulfide oxidation to occur in said first oxidation zone to generate an amount of sulfuric acid sufficient to react with the remainder of said inorganic carbonates and said other acid consumers and also form at least about 5 grams of free sulfuric acid per liter in said first zone and wherein the temperature of the slurry in said first oxidation zone is between about 360° F. to about 440°;

(e) introducing additional oxygen into the slurry phase of each subsequent oxidation zone while maintaining an oxygen partial pressure of at least about 25 psia in each of said gas phases and while maintaining the temperature of said slurry in each of said subsequent oxidation zones in the range of about 360° F. to about 440°F.;

(f) removing a slurry containing a final oxidized slurry, said slurry having an EMF of at least about 500 millivolts; and (g) removing a gas stream from the gas phase of at least said first oxidation zone, cooling the gas stream, separating carbon dioxide from the oxygen in said cooled gas, and recycling said oxygen to said oxidation zones.

11. The method of claim 10 wherein said temperature in said oxidation zones is between about 400° F. and about 420° F.

12. The method of claim 10 wherein ratio of moles of sulfide to moles of total acid consumers is between about 1.4 and about 1.7.

13. The method of claim 11 wherein at least about 70 percent of the sulfide oxidation occurs in said first oxidation zone.

14. The method of claim 10 wherein said partial pressure of oxygen in each oxidation zone is at least about 80 psia.

15. The method of claim 10 wherein the free acid in said final oxidized slurry is at least about 10 grams per liter.

16. A method for liberating precious metal values from refractory carbonate ores which contain inorganic sulfides and acid consumers, said method comprising:

(a) adjusting a molar ratio of sulfide to total acid consumers to within a range of about 1.2 to about 3.2 to provide an adjusted ore feed;

(b) contacting an aqueous slurry of said adjusted ore feed with oxygen at a slurry temperature of at least about 360° F. in a first oxidation zone and at least one subsequent oxidation zone, each of said oxidation zones having a slurry phase and a gas phase, to form a final oxidized pulp slurry and convert at least a portion of said sulfide to sulfuric acid wherein at least about 65 percent of said conversion occurs in the first oxidation zone, wherein sulfuric acid is generated in an amount sufficient to react with said acid consumers and also form at least about 5 grams of free sulfuric acid per liter of slurry in said first oxidation zone; and (c) removing a portion of a gas phase containing oxygen and carbon dioxide from at least one of said oxidation zones and separating substantially all of the carbon dioxide from said oxygen before recycling the oxygen to the oxidation zones.

17. The method of claim 16 wherein said carbon dioxide is separated from said oxygen by contacting said gas phase with hot potassium carbonate.

* * * * *